United States Patent [19]

Uetrecht

[11] 3,999,149

[45] Dec. 21, 1976

[54] MODULATION SYSTEM

[75] Inventor: Dale M. Uetrecht, Colerain Township, Hamilton County, Ohio

[73] Assignee: D. H. Baldwin Company, Cincinnati, Ohio

[22] Filed: June 20, 1975

[21] Appl. No.: 588,628

[52] U.S. Cl. ..... 332/17; 84/1.26; 332/16 T; 332/31 T; 332/47

[51] Int. Cl.[2] ..... G10H 1/02

[58] Field of Search ..... 332/31 T, 17, 16 T, 332/41; 331/47; 84/1.26

[56] References Cited

UNITED STATES PATENTS

| | | | |
|---|---|---|---|
| 2,994,044 | 7/1961 | Straube | 332/31 T |
| 3,202,939 | 8/1965 | Reiling | 332/31 T |
| 3,656,008 | 4/1972 | Nakagomi | 84/1.26 |
| 3,708,603 | 1/1973 | Keagle | 84/1.26 |
| 3,823,244 | 7/1974 | Nagahama | 84/1.26 |
| 3,866,148 | 2/1975 | Lisle, Jr. | 332/31 T |
| 3,895,316 | 7/1975 | Fein | 332/17 |

*Primary Examiner*—John Kominski
*Attorney, Agent, or Firm*—Kirkland & Ellis

[57] ABSTRACT

A modulator for modulating an audio signal in response to a dc signal of adjustable level and concurrently in response to a sub-audio signal, in which the modulating signals do not appear in the output of the modulator nor intermodulate each other, the system including transistor pairs which respond differentially at the bases to the modulating signal and additively to the audio signal in response to application of the audio signal at the emitters.

4 Claims, 2 Drawing Figures

MODULATION SYSTEM

BACKGROUND OF THE INVENTION

It is desirable to process audio signals delivered by an electronic organ by frequency modulating and amplitude modulating the signals concurrently at a sub-audio frequency, thereby simulating the effect of a Leslie rotating accoustic radiator but without requiring mechanical devices. It is conventional to employ a transistor circuit as a modulated amplifier, and such circuits exist which are capable of responding to a large range of modulation signal amplitudes and delivering a wide range of signal output amplitudes without distortion or passing through of the modulating signals.

In accordance with one embodiment of the present invention, a first transistor is provided with audio signal, which may be derived from an electronic organ, into its emitter through a resistance large relative to base-emitter resistance. Dc and sub-audio modulating signals are applied to the base of the transistor, and thereby both modulate the amplitude of the audio signal at the collector of the transistor, but do not affect each other, so that each may be independently selected in respect to amplitude and will separately and independently modulate the audio signal. The modulating signals are cancelled by means of a second transistor amplifier, but the modulated signal is not cancelled.

SUMMARY OF THE INVENTION

A modulator, including at least two transistors, capable of responding to large modulating signals, both dc and sub-audio, in which the modulating signals are not intermodulated and do not appear in the output of the modulator.

DETAILED DESCRIPTION

EMBODIMENT NO. 1

Figure 1:
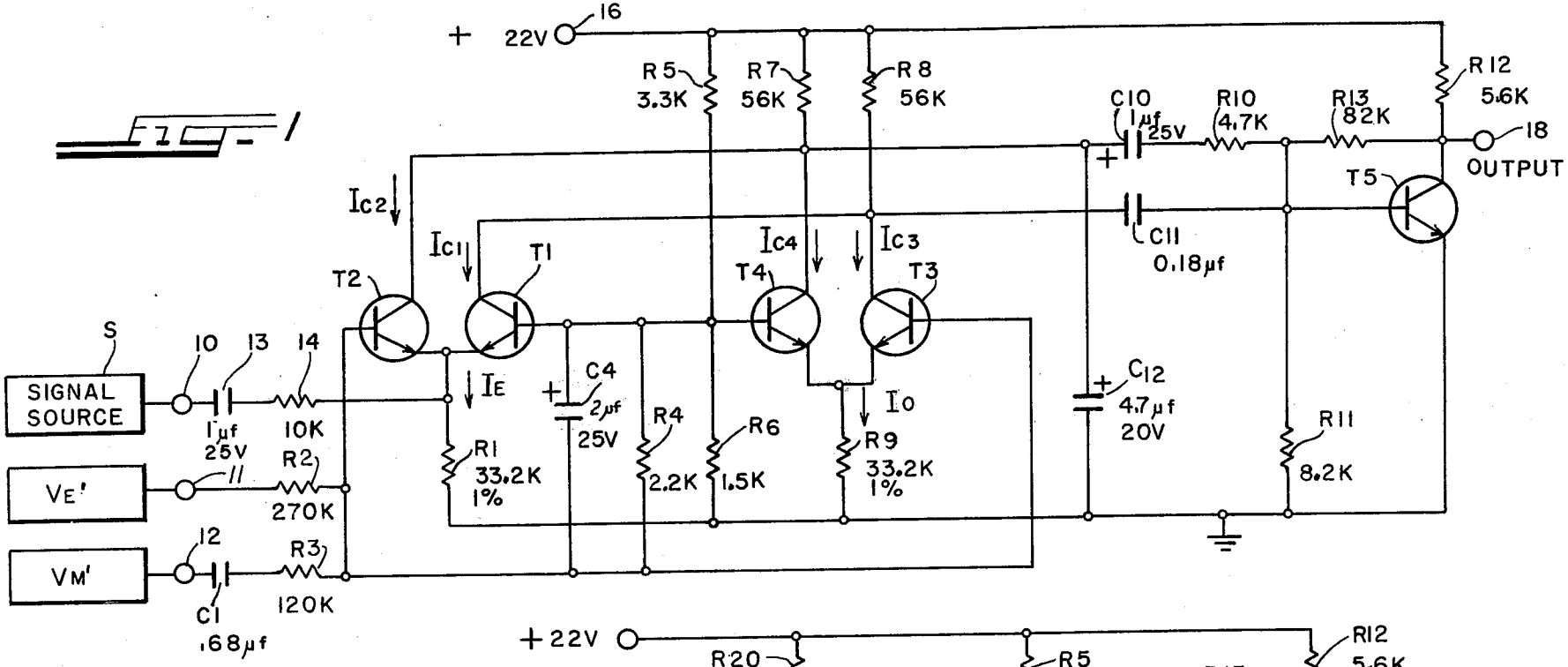
FIG. 1 is a schematic circuit diagram of one embodiment of the invention.

Terminal 10 is connected to a wide band audio signal source S. Terminal 11 is connected to a source of dc voltage $V_E'$, which may derive from the expression control circuit of an electronic organ and may have a wide range of voltage levels, all positive. Terminal 12 is connected to a source of sub-audio modulating signals, which may be of variable frequency, about 6 Hz.

The terminal 10 is connected via capacitor 13 and resistor 14 in series to the emitters of transistors $T_1$ and $T_2$, which are commonly connected to ground via a large resistance $R_1$ (33.2K) so that an essentially constant current $I_E$ is conducted from $T_1$ and $T_2$ through $R_1$ to ground.

Terminal 11 is connected to the base of $T_2$ via resistance $R_2$ (270.K), and terminal 12 to this same base via capacitor $C_1$ and resistance $R_3$ (120.K).

The base of $T_2$ is connected via resistance $R_4$ to the base of $T_1$ and the latter is directly connected to a fixed bias source, consisting of resistances $R_5$ and $R_6$ in series between positive voltage terminal 16 and ground. Signals $V_E'$ and $V_M'$ are therefore connected to the base of $T_1$ via voltage dividers including in the case of $V_E'$, $R_2$, $R_4$, $R_6$. The base of $T_1$ thus remains practically fixed in voltage, while the voltage at the base of $T_2$ varies. The differential voltage across $R_4$ is $V_M+V_E=V_D$.

The collector resistors for $T_2$ and $T_1$ are, respectively, $R_7$ and $R_8$ and equal.

The base of $T_1$ is directly connected to the base of a transistor $T_4$, while the base of $T_2$ is directly connected to the base of a transistor $T_3$. $T_4$ and $T_3$ have collector loads $R_7$ and $R_8$, respectively, i.e. the same loads as have $T_2$ and $T_1$. The emitters of $T_4$ and $T_3$ have a common resistance to ground, $R_9$ which is equal to $R_1$ so that the current $I_0$ is essentially equal to $I_E$.

The collectors of $T_2$ and $T_4$ are connected to the base of transistor $T_5$ via a filter composed of capacitor $C_{10}$ and resistance $R_{10}$. The base of $T_5$ is connected to ground via resistance $R_{11}$. The collector of $T_3$ is connected to the base of $T_5$ via capacitor $C_{11}$. An audio bypass capacitor $C_{12}$ (4.7uf is connected between the collectors of $T_2$ and $T_4$ and ground to attenuate high frequency audio signals in conjunction with $R_{10}$ and $C_{10}$.

Transistor $T_5$ is connected as a collector loaded current summing amplifier having a collector load $R_{12}$, a collector to base resistance $R_{13}$, and a grounded emitter. The output terminal of the modulator is 18. At the output terminal 18 appears a modulated form of signal S, but not the signal $V_M'$, or $V_E'$. Further, the level of $V_M'$ does not affect the level of $V_E'$ and vice versa, so that the wide band organ signal can be modulated from the expression pedal of the organ and from a sub-audio modulation oscillator.

Capacitor $C_4$ is a high frequency noise by-pass around $R_4$.

It is conventional to use a transistor or transistors as a modulated amplifier. Conventionally the signal is applied to the base lead with the emitter bypassed to ground, or using a differential pair the signal is applied between the two base leads with the two emitters common. The modulation is achieved by injecting a modulation current into the emitter. The transconductance at low frequencies is approximately:

$$i_{out}/v_{in}=1/h_{ib}\cong I_E/0.026(\text{volts}) \quad (1)$$

This is ideal where a linear modulation is required:

$$I_E = I_o + I \sin w_m t \quad (2)$$

$$\therefore\ i_{out} = v_{in}/0.026\ (I_o + I \sin w_m t) \quad (3)$$

Where two transistors are used:

$$i_{out}/v_{in} = 1/(h_{ib1}+h_{ib2}) \cong I_{E1}/0.052 \quad (4)$$

$$I_{E1} = (I_o + I \sin w_m t)/2 \quad (5)$$

$$\therefore\ i_{out} = (v_{in}/0.104)(I_o+I \sin w_m t) \quad (6)$$

These equations apply for small signals. The advantage of using two transistors is that there is less distortion at any given signal level than for one transitor. If two pairs of transistors are modulated 180° out of phase, and the output of one pair is subtracted from the other, the result is:

$$i_1 = (V_{in}0.104)\ I_o(1+a\sin w_m t) \quad (7)$$

$$= I_c\sin w_c t + I_m \sin w_c t \sin w_m t + I_c \sin w_c t + I_m/2\text{-}[\cos(w_c-w_m)t\text{-}\cos(w_c+w_m)t] \quad (8)$$

$$i_2 = I_c \sin w_c t + \{I_m/2 \cos[(w_c - w_m)t - \pi] - \cos[(w_c + w_m)t + \pi]\} \quad (9)$$

$$i_o = i_1 - i_2 = I_m[\cos(w_c - w_m)t - \cos(w_c + w_m)t] \quad (10)$$

In the present invention, the signal is applied to the common emitters, and expression control voltage plus tremolo modulation voltage are applied between the base leads. Several desirable differences result. First, injection of the signal into the emitters through a relatively large resistor results in low distortion. Second, the expression control voltage is not restricted to small values as was the signal in the balanced modulator. It is in fact made large to take advantage of the exponential nature of large signal base-emitter characteristics.

The current injected into the emitters is, in FIG. 1, $$I_E = I_o + I_s \sin(w_s t) \quad (11)$$

If no differential voltage is applied to the base leads, the current divides equally between the two collectors (neglecting base current).

$$I_{c1} = I_{c2} = \tfrac{1}{2} I_E \quad (12)$$

When a differential voltage $V_D$ is applied:

$$I_{c1} = I_E \left( \frac{1}{1 + e^{V_D/KT/q}} \right) \quad (13)$$

$$= I_E \left( \frac{1}{1 + e^{V_D/.026}} \right) \quad (14)$$

When $V_D$ is negative and large compared to 0.026 volts:

$$I_{c1} \cong I_E \quad (15)$$

When $V_D$ is large compared to 0.026 volts:

$$I_{c1} \cong I_E e^{\frac{-V_D}{.026}} \quad (16)$$

Where the differential voltage equals the sum of the expression voltage and the tremolo modulation voltage:

$$V_D = V_E + V_M \quad (17)$$

and:

$$I_{c1} \cong I_E e - V_D/0.026 = I_o + I_s \sin w_s t)(e^{-V_D/0.026}) \quad (18)$$

Then:

$$I_{c1} \cong I_E (e^{-V_E/0.026})(e^{-V_M/0.026}) \quad (19)$$

It follows that the modulation due to expression does not affect the tremolo modulation.

An additional feature of the present circuit is the use of two pair of transistors to cancel the modulation current:

$$I_{c3} = I_o[1/(1 + e^{-V_D/0.026})] \quad (20)$$

$$I_{c1} + I_{c3} = I_o + (1/1 + e^{+V_D/0.026}) I_s \sin(w_s t) \quad (21)$$

It follows that the voltage $V_D$ modulates the signal current $I_s$ but does not modulate the bias current $I_o$.

The cancellation is dependent upon two parameters: first, the bias current supplied by the one percent resistors $R_1$ and $R_9$ being equal; second, the relative matching of the transistors. The matching is accomplished by using a single chip transistor array. The cancellation is typically better than −30db and can be improved by selection of one resistor.

An additional feature of the present circuit is frequency compensation. The current from the other two transistors is combined:

$$I_{c2} + I_{c4} = I_o + (1/1 + e^{-V_D/0.026}) I_s \sin w_s t \quad (22)$$

and passed through a low pass filter whose transfer function is:

$$I_{out}/I_{in} = (1/6)(1/1 + RCS). \quad (23)$$

The result is that at low frequencies the attenuation is limited to 1/6 or −16db. At high frequencies the attenuation is limited only by $V_D$ and is set at 1/50 or −34dB.

In the practical case it is not necessary to limit $V_D$ to large positive voltages. The audio component of the output current at mid to high frequencies is:

$$i_{out}/i_{in} = y = (1/1 + e^x) \text{ where: } x = V_D/0.026 \quad (24)$$

The modulation of the current is given by:

$$m = \frac{dy}{dx} \frac{\Delta X}{y} = \frac{-\Delta X e^x}{1 + e^x} \quad (25)$$

It is seen that for $x$ large compared to 1, $m = -\Delta x$ $$\text{at } x = 0;\ m = -\Delta x/2 \quad (26)$$

$$\text{at } x = -1.1;\ m = -x/4 \quad (27)$$

$$\text{at } x = -1.95;\ m = -\Delta x/8 \quad (28)$$

In the present application $x$ varies from −2 to +4 resulting in a dynamic range of approximately 34dB. If less compression of the full gain end of the expression range were desired, $x$ could be varied from −1 to +4.2 to maintain 34dB range.

In essence, $T_4$ and $T_3$ act to compensate the output of $T_2$, $T_1$, and on a more fundamental level the output of $T_4$ cancels modulation signal deriving from $T_2$. The utilization of differential pairs in place of single transistors reduces noise.

Figure 2:
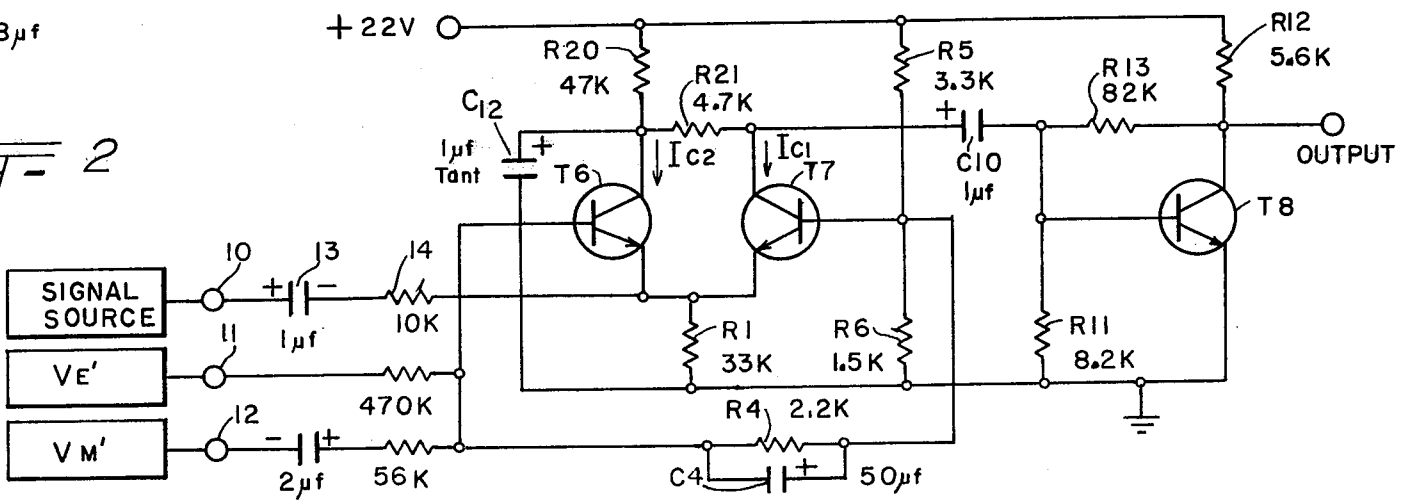
FIG. 2 is a schematic circuit diagram of a modification of the embodiment of FIG. 1.

FIG. 2 is a three-transistor version of the system of FIG. 1. In the system of FIG. 2, the audio signal is applied through capacitor 13 and resistor 14 to the junction of $R_1$ and the common emitters of transistors $T_6$ and $T_7$. The collector of $T_6$ is loaded by a resistance $R_{20}$. The collectors of $T_6$ and $T_7$ are joined by a resistance $R_{21}$. The collector of $T_7$ is connected through capacitor $C_{10}$ to the base of Transistor $T_8$ which functions in the same manner as $T_5$ in FIG. 1. An offset voltage appears across the resistance $R_{21}$. However, capacitor $C_4$ prevents high frequency offset, and capacitor $C_{10}$ blocks low frequency offset, reducing it to an acceptable level. Capacitor C12 (1 $\mu$f Tant) is an audio bypass capacitor connected between the collector of transistor T6 and ground to attenuate high frequency audio signals in conjunction with R21.

Low frequency response is changed from $$1/6 \cdot \frac{1}{1 + RC_x} \text{ to } 1/2 \cdot \frac{1}{1 + RC_x}$$

so that the expression range is 6db at low frequencies and 17db at high frequencies. The expression voltage can only vary very slowly, in any event, which renders the design of FIG. 2 practical.

What I claim is:

1. A modulating system for an electronic musical instrument comprising:

a first transistor and a second transistor forming a pair of transistors, said transistors having a base, emitter, and collector, said first and second transistors having their emitters connected together;

a source of audio current signals connected to the emitters of said first and second transistors;

a first resistor connecting the emitters of said first and second transistors to ground;

a first source of essentially fixed DC bias voltage connected to the base of said first transistor;

a second source of DC bias voltage connected to the collectors of said first and second transistors;

a source of control voltage connected to the base of said second transistor, said control voltage having an AC modulating voltage component and a DC modulating voltage component for modulating the audio current signals; and a current summing amplifier having an input and an output; and collector means for connecting the collectors of said first and said second transistors to the input of said current summing amplifier so that said control voltage modulates the percentage of said audio current signals reaching the output of said current summing amplifier over a wide dynamic range, and so that the percentage of said audio current signal reaching the output of said current summing amplifier is further modulated by said AC modulating voltage component causing the percentage of audio current signal modulated by said AC modulating voltage component to remain essentially constant over said wide dynamic range, and the amount of AC modulating voltage reaching the output of said summing amplifier is reduced by cancellation.

2. A modulating system, in accordance with claim 1, wherein said collector means includes an audio bypass capacitor connected between the collector of said second transistor and ground;

a resistor connected between the collectors of said first and second transistors; and a coupling capacitor connected between the collector of said first transistor and the current summing amplifier;

thereby a wide dynamic modulation over most of the audio range and a reduced modulation at low audio frequencies is achieved.

3. A modulating system, in accordance with claim 1, wherein said collector means includes:

a third and fourth transistor forming a second transistor pair, said third and forth transistors having a base emitter, and collector; and having their emitters connected together;

a second resistor connected between ground and both emitters of said third and fourth transistors, and said third transistor having its base connected to the base of said second transistor and its collector connected to the collector of said first transistor, said fourth transistor having its base connected to the base of said first transistor and its collector connected to the collector of said second transistor, the collectors of said first and third transistors being connected to the input of said current summing amplifier by a coupling capacitor, the collectors of said second and fourth transistors being connected to ground via a bypass capacitor and to the input of the current summing amplifier via a resistor and a coupling capacitor, whereby wide dynamic modulation over most of the audio range and reduced modulation at low audio frequencies is achieved and the amount of AC modulating voltage reaching the output is further reduced by cancellation.

4. A modulating system, as claimed in claim 1, wherein said DC modulating voltage component causes modulation in a dynamic range in the order of 34 db, and said AC modulating voltage component causes modulation in the order of plus or minus or 1 to 3 db.

* * * * *